US005339132A

United States Patent [19]

Tomita et al.

[11] Patent Number: 5,339,132

[45] Date of Patent: Aug. 16, 1994

[54] MOUNT STRUCTURE OF A LIGHT EMITTING ELEMENT ARRAY IN ELECTRONIC PHOTOGRAPHIC APPARATUS

[75] Inventors: Hiroyuki Tomita; Kohichi Yoshida, both of Tokyo, Japan

[73] Assignees: Fujitsu Isotec Limited, Kanagawa; Fujitsu Limited, Tokyo, both of Japan

[21] Appl. No.: 982,736

[22] PCT Filed: Jul. 16, 1992

[86] PCT No.: PCT/JP92/00907

§ 371 Date: Mar. 4, 1993

§ 102(e) Date: Mar. 4, 1993

[30] Foreign Application Priority Data

Jul. 16, 1991 [JP] Japan ..... 3-174997
Feb. 27, 1992 [JP] Japan ..... 4-040861

[51] Int. Cl.[5] ..... G03G 21/00; G03G 15/00

[52] U.S. Cl. ..... 355/200; 346/107 R; 355/228; 355/67

[58] Field of Search ..... 355/200, 202, 228, 229, 355/67; 346/107 R

[56] References Cited

U.S. PATENT DOCUMENTS 4,566,015 1/1986 Mackenzie ..... 346/107 R
4,715,682 12/1987 Koek et al. ..... 355/1
4,728,981 3/1988 Koek et al. ..... 355/1
4,864,364 9/1989 Ogino et al. ..... 355/202
4,875,153 10/1989 Hous ..... 346/160
4,985,731 1/1991 Sakakura et al. .
5,089,846 2/1992 Tabuchi ..... 355/200
5,095,337 3/1992 Yamaguchi ..... 355/229

FOREIGN PATENT DOCUMENTS 55-107345 7/1980 Japan .
56-31372 7/1981 Japan .
58-166362 10/1983 Japan .
0286769 12/1987 Japan ..... 346/160
1-216371 8/1989 Japan .
1-279272 11/1989 Japan .
1-172062 12/1989 Japan .
1-173749 12/1989 Japan .
2-214674 8/1990 Japan .
2-285366 11/1990 Japan .

*Primary Examiner*—Matthew S. Smith
*Attorney, Agent, or Firm*—Armstrong, Westerman Hattori, McLeland and Naughton

[57] ABSTRACT

A light emitting element array in an electronic photographing apparatus, in which a photoconductor drum is exposed to a light from a light emitting array having a plurality of light emitting diodes to form a latent image on the drum, and a high quality, stable light image can be deposited on the photoconductor drum from a light emitting array, even after extended use. The constitution is such that a fixed bracket 31 is fixedly mounted on the electronic photographing apparatus, a rotatable bracket 33 is rotatably mounted on the fixed bracket and fixedly secured to the light emitting element array 2, a bias means 37 urges the light emitting element array 2 against the outer surface of the photoconductor drum 1, a space keeping means 38 is pushed by the bias means against the outer surface of the photoconductor drum so as to maintain a constant distance between the light emitting element array and the outer surface of the photoconductor drum 1.

7 Claims, 5 Drawing Sheets

MOUNT STRUCTURE OF A LIGHT EMITTING ELEMENT ARRAY IN ELECTRONIC PHOTOGRAPHIC APPARATUS

TECHNICAL FIELD

This invention relates to a mount structure of a light emitting element array in an electronic photographing apparatus, in which a photoconductor drum is exposed to a light from a light emitting array having a plurality of light emitting diodes to form a latent image on the drum.

In such a mount structure of a light emitting element array in an electronic photographing apparatus, a beam emitted from a light emitting element is focused on a photoconductor drum by a lens so that a beam radiated from one light emitting element forms one dot of an image. Therefore, a precise distance between the light emitting array and the photoconductor drum must be maintained.

BACKGROUND ART

FIG. 5 shows a mount structure of a light emitting element array in an electronic photographing apparatus known in the prior art (FIG. 5(A) being a front view and FIG. 5(B) being a side view). A plurality of light emitting diodes (LED) are arranged on a LED array 91 that is rigidly mounted on leaf springs 92. The bearings (spacing means) 94 rotatably mounted on the LED array 91 are urged to the photoconductor drum 95, so that the distance between the LED array 91 and outer periphery of the photoconductor drum (information recording media) 95 remains constant.

However, due to the rotating photoconductor drum 95, the leaf springs 92 vibrate in the direction A, so that the bearings 94 do not stably contact the surface of the photoconductor drum 95. Therefore, the leaf springs 92 are pushed from the back thereof by means of rubber dampers 97 mounted on the fixed bracket 96 so as to restrict the vibration of the leaf springs 92 and prevent a rough printing.

In the mount structure of a light emitting element array in an electronic photographing apparatus known in the prior art as mentioned above, the bearings 94 are strongly urged to the surface of the photoconductor drum 95 by a damping force of the rubber dampers in addition to a spring force of the leaf springs 92 and, therefore, the surface of the photoconductor drum 95 becomes worn after extended use, so that the distance between the LED array 91 and the periphery of the photoconductor drum 95 is reduced. Thus, focusing on the photoconductor drum 95 for one dot will be out of order and image quality will deteriorate.

Also, the leaf spring 92, particularly, the central portion 92*a* thereof which is not pushed by the rubber damper 97 vibrates or is twisted, so that the image deposited on the photoconductor drum 95 will deteriorate or will produce jitters (disorder of dots) and image quality is reduced.

DISCLOSURE OF INVENTION

An object of the present invention is to provide a mount structure of a light emitting element array in an electronic photographing apparatus, in which a high quality stable light image can be deposited on the photoconductor drum from a light emitting array, even after extended use.

According to the present invention, there is provided a mount structure of a light emitting element array in an electronic photographing apparatus, comprising a cylindrical photoconductor drum rotatably driven around an axis, a light emitting element array having a plurality of light emitting elements arranged parallel to the axis of the photoconductor drum and opposite to an outer surface thereof, characterized by a fixed rigid bracket fixedly mounted on the electronic photographing apparatus; a rotatable rigid bracket rotatably mounted on the fixed bracket and fixedly secured to the light emitting element array; a bias means for urging the light emitting element array against the outer surface of the photoconductor drum; a space keeping means that is pushed by the bias means against the outer surface of the photoconductor drum so as to maintain a constant distance between the light emitting element array and the outer surface of the photoconductor drum.

It is advantageous for the rotatable bracket to be rotatably mounted on the fixed bracket by a pair of bearings arranged a certain interval apart in such a manner that, at one of the bearings, the rotatable bracket is supported on said fixed bracket so as to be movable and parallel to the beam radiated from the light emitting element array.

In addition, both the fixed bracket and the rotatable bracket may be made of rigid metal plates. The space keeping means comprises bearings rotatably mounted on the light emitting element array in such a manner that said bearings are forced against the outer surface of the photoconductor drum and rotated by the rotation of the photoconductor drum.

Thus, the light emitting element array is supported by the fixed bracket and the movable bracket made of rigid bodies and urged toward the outer surface of the photoconductor drum with the rotatable bracket by the bias means. The distance between the light emitting element array and the other surface of the photoconductor drum can remain constant by the space keeping means.

In another aspect of the present invention, there is provided a mount structure of a light emitting element array in an electronic photographing apparatus, comprising a fixed bracket and a rotatable bracket rotatably mounted on the fixed bracket at the respective ends thereof in the axial direction and providing a light emitting element array for forming an electrostatic latent image; said array having a plurality of light emitting elements along the axial direction of the information recording media (photoconductor drum) rotatably driven about an axis thereof and a pair of gap keeping means for maintaining a gap with the photoconductor drum; a first bias means, provided between the fixed bracket and the rotatable bracket, for urging the light emitting element array so that both space keeping means are in contact with the photoconductor drum; one of the respective axial ends at which said rotatable bracket rotatably connected to said fixed bracket is only rotatably supported to said fixed bracket, and the other end being connected to the same rotatably and movably toward and away from the photoconductor drum; and second bias means integrally mounted on said fixed bracket for urging said other end of the rotatable bracket toward said photoconductor drum.

Although a portion of the elongated hole of the rotatable bracket is subjected to micro-vibration, the portion is urged toward the information recording media by the second bias means integrally mounted on the movable bracket, thereby restricting such a vibration and preventing a printing disorder.

BEST MODE FOR CARRYING OUT THE INVENTION

Embodiments will now be described with reference to the drawings.

Figure 2:
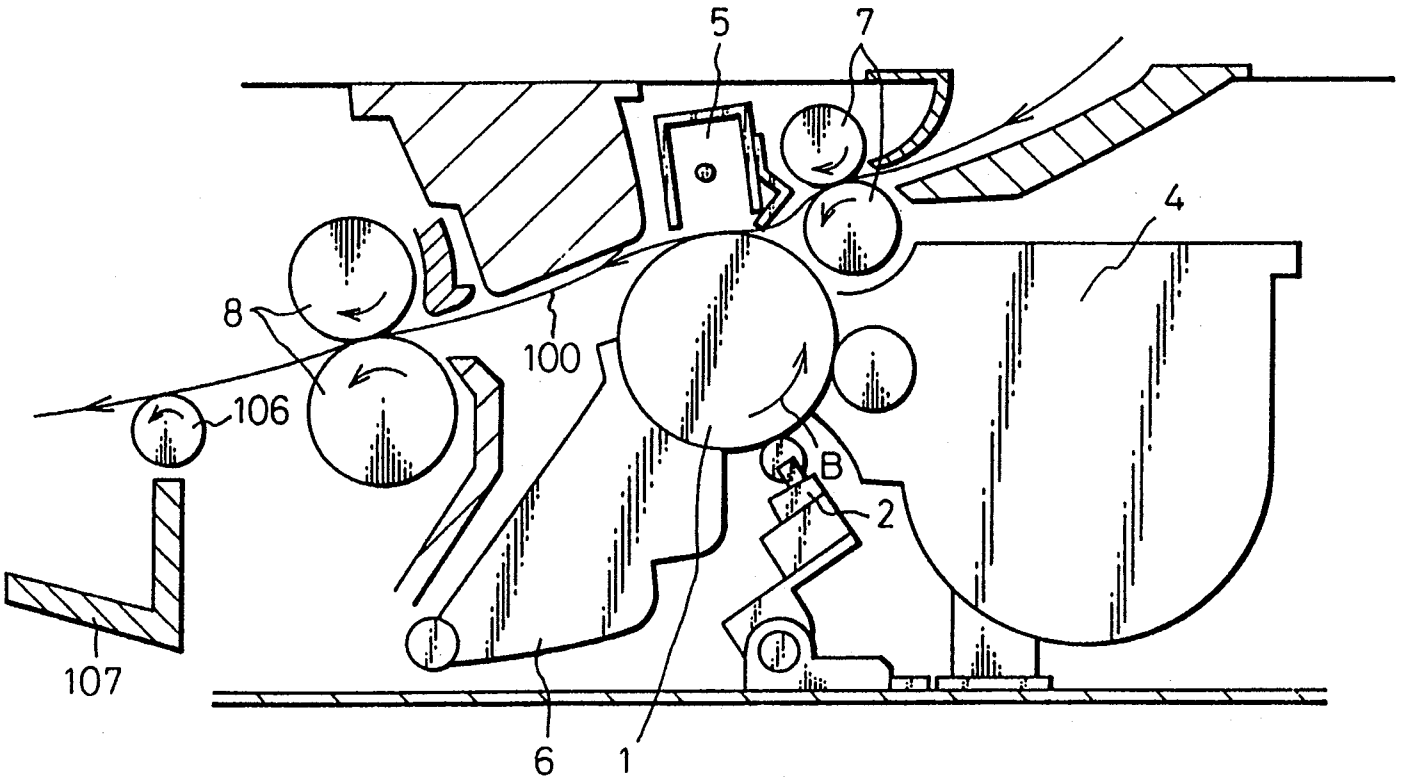
FIG. 2 is a side schematic view of a printer according to the present invention.

FIG. 2 shows a printer of the present invention. In the drawing, the reference numeral 1 denotes a photoconductor drum rotated in the direction B about an axis and has a cylindrical outer surface electrified by a pre-electrification unit, not illustrated.

The reference numeral 2 denotes a light emitting diode array in which a plurality of light emitting diodes are arranged parallel to the axial direction of the photoconductor drum 1. One image beam of one dot from one light emitting diode is radiated to the outer surface of the photoconductor drum and a latent image is formed on the outer surface of the photoconductor drum 1.

The reference numeral 4 denotes a developing unit for developing the latent image on the photoconductor drum 1 with a toner; 5, a transfer unit for transferring the toner image on the photoconductor drum 1 to a recording sheet; and 6, a cleaner for cleaning the toner remaining on the outer surface of the photoconductor drum 1. The recording sheet 100 is fed by a sheet feeding roller 7 to a passage in a printer and the toner image is fixed onto the recording sheet 100 by a fixing unit. The fixed recording sheet 100 is then discharged by a discharge roller 106 to a stacker 107, and after the transfer operation, the surface of the photoconductor drum 1 is cleaned by the cleaner 6.

Figure 1:
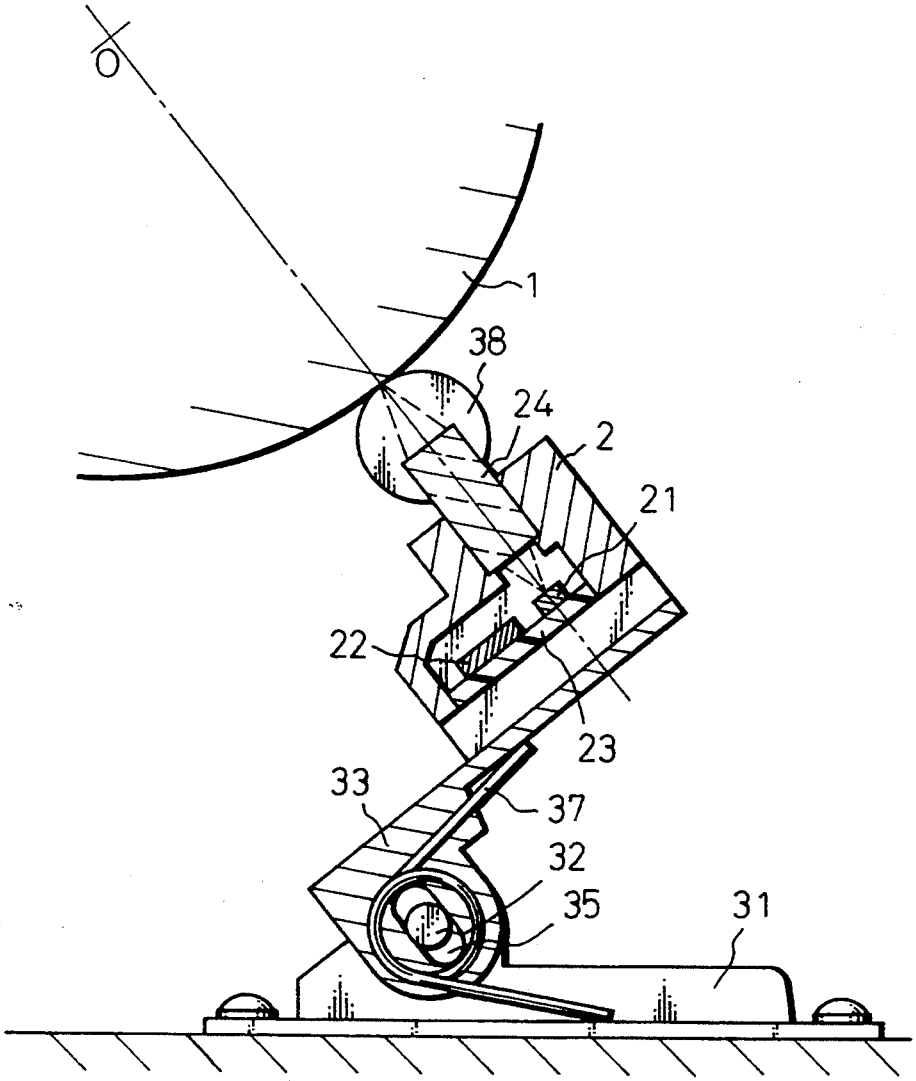
FIG. 1 is a side cross-sectional view of a first embodiment.
Figure 3:
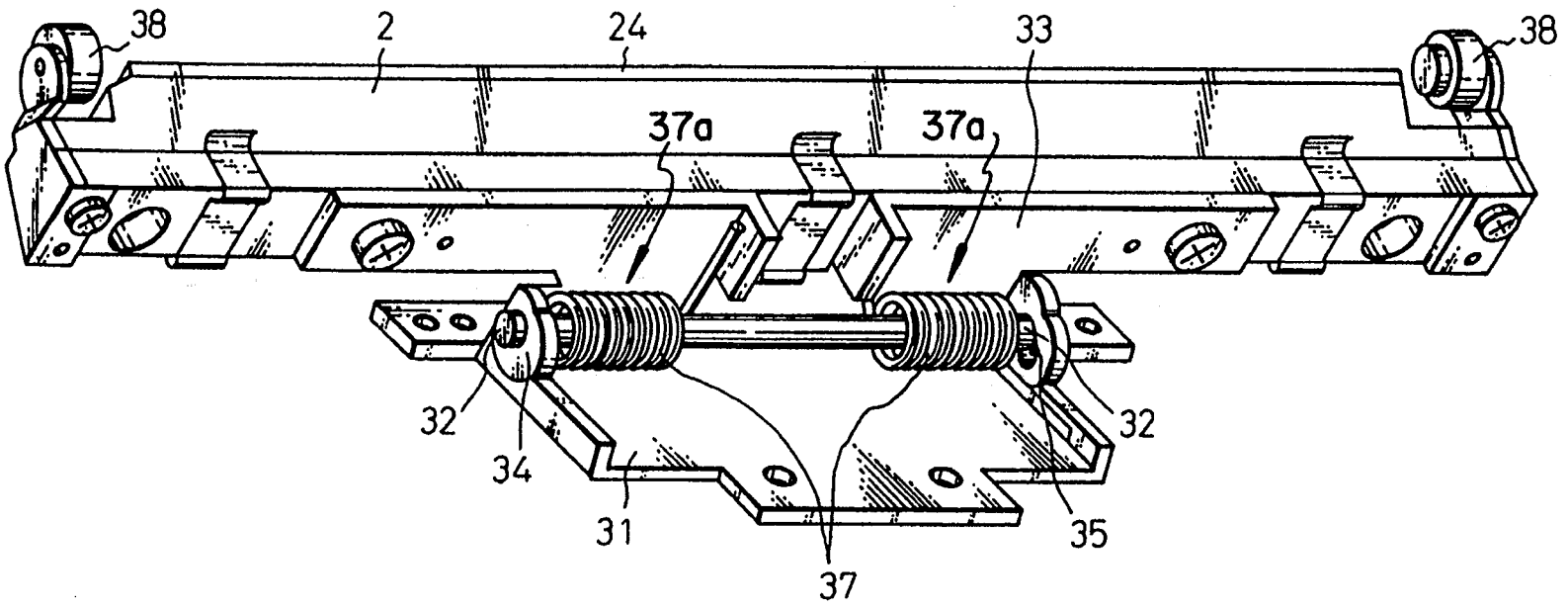
FIG. 3 is a perspective view of the first embodiment.

FIG. 3 is a perspective view of a supporting section for supporting the light emitting diode array and FIG. 1 is a side sectional view thereof.

The reference numeral 21 denotes a light emitting diode (LED); and 22 denotes a drive circuit thereof, which are both mounted on a printed board 23. A beam emitted from the light emitting diode 21 is focused by a focusing lens 24 on the outer surface of the photoconductor drum 1. The light path of this beam is directed to the center axis 0 of the photoconductor drum 1.

The reference numeral 31 denotes a fixing bracket made of a rigid metal plate fixed on the printer by screws. The shafts 32 are projected from the right and left ends of the bracket. A rotatable bracket 33 also made of a rigid metal plate is rotatably supported on the shafts 32. One of the bearing holes 34 and 35 engaged with the shafts 32 has a circular section engaged with the shaft 32 and the other bearing hole 35 is an elongated hole extending in the same direction as the light path of the beam emitted from the light emitting diode 21.

The reference numeral 37 is a torsion spring for urging the rotatable bracket 33 around the shaft 32 and, thus, the light emitting diode array 2 is urged toward the outer surface of the photoconductor drum 1. Said torsion springs each including a spiral portion 37*a* which is spiralled around shaft 32, as shown in FIG. 3.

The respective bearings 38 are rotatably mounted at the left and right ends of the light emitting diode array 2, so that the head portions thereof are projected toward the photoconductor drum 1. Therefore, the bearings 38 are always urged to the outer surface of the photoconductor drum 1 by the bias force of the torsion springs 37 and thus the distance between the light emitting diode array 2 and the photoconductor drum 1 always remains constant.

Due to the position or mount errors of various members, such as, the fixed bracket 31 and the photoconductor drum 1, the light emitting diode array 2 may not be parallel to the outer surface of the photoconductor drum 1 and, therefore, one of the pair of bearings 38 may not contact the photoconductor drum 1.

However, since one of the bearing holes is an elongated hole parallel to the light path of the beam as mentioned above, the shaft 32 at the side of the elongated bearing hole 35 is freely movable in the direction parallel to the light path, toward or away from the outer surface of the photoconductor drum 1.

Therefore, if the bracket 31 is fixed so that the position at the circular bearing hole 34 is set at an appropriate position, the left and right bearings 38 are both urged to the outer surface of the photoconductor drum 1 and thus the light emitting diode array 1 is automatically set in an appropriate position so as to be parallel to the outer surface of the photoconductor drum 1.

According to the first embodiment of a mount structure of a light emitting element array in an electronic photographing apparatus, the rotatable bracket for mounting the light emitting element array and the fixed bracket for supporting the same are both rigid bodies and mutually and rotatably connected by means of a bias means. Therefore, vibration or torsion can be prevented as a whole and a high quality light image can be produced on the photoconductor drum.

In addition, it is no longer necessary to provide a rubber damper or the like to absorb the vibration, and therefore the space keeping means, such as bearings, can be forced to the surface of the photoconductor drum by a small force. Therefore, wear of the photoconductor drum is very small for extended use and the distance between the light emitting element and the outer surface of the photoconductor drum is minimal, and thus a good focus, less jitter and stable exposure can be maintained.

Also, one of the supporting means for supporting the light emitting element array by its respective ends is movable and parallel to the light path of the beam, and therefore the light emitting element array is automatically parallel to the outer surface of the photoconductor drum. Thus, since a parallel adjustment is no longer necessary at the time of assembling the same, a mount can very easily be effected and the apparatus can be assembled beforehand as an unit.

Figure 4:
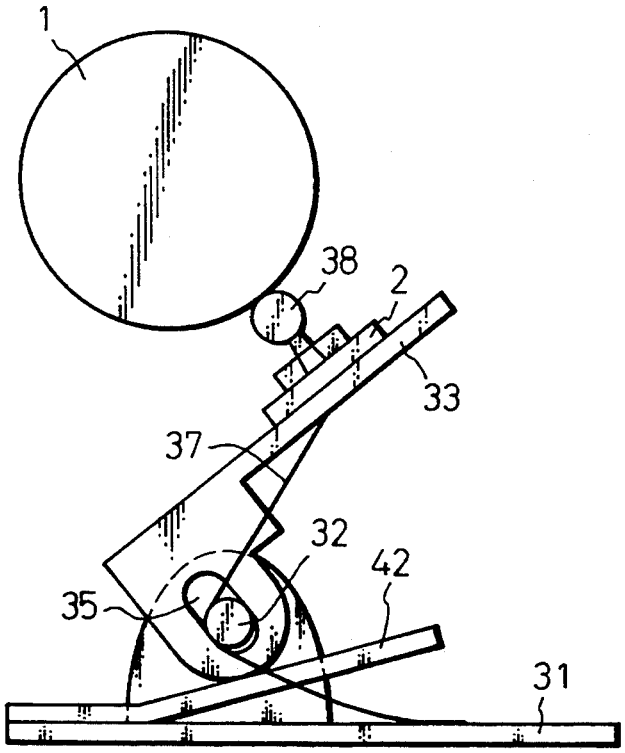
FIG. 4 is a side view of a second embodiment.
Figure 5A:
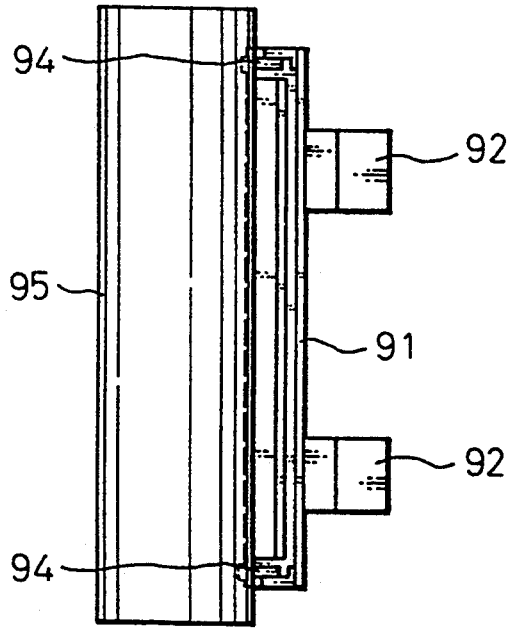
Fig.5A PRIOR ART
FIG. 5 shows a prior art, particularly, (A) is a front view and (B) is a side view.
Figure 5B:
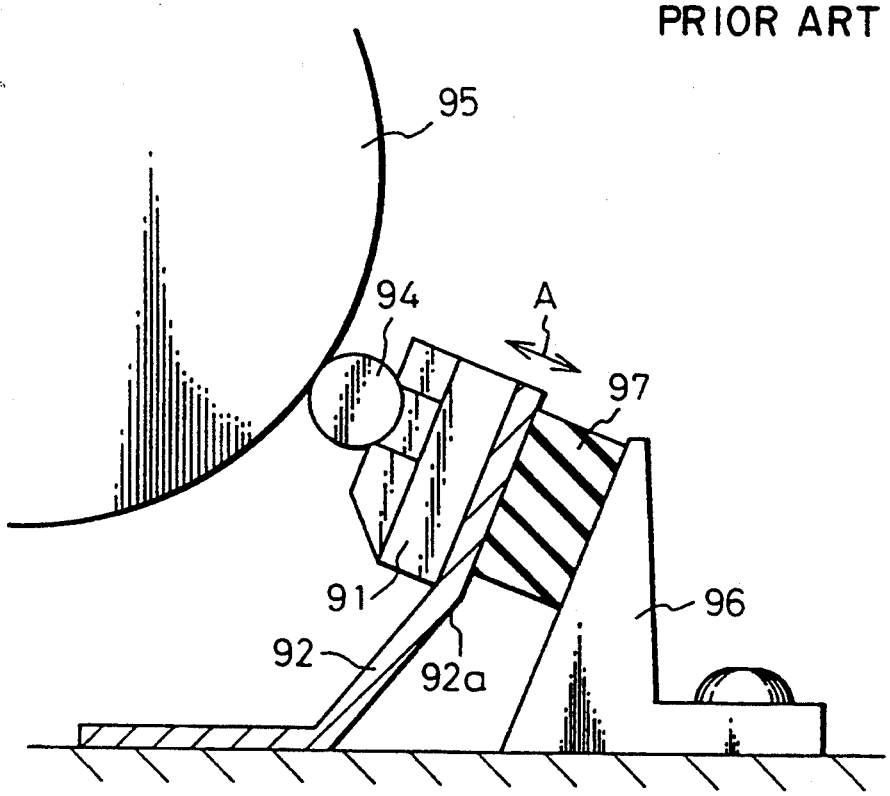
Fig.5B PRIOR ART

FIG. 4 is a side view of a second embodiment of a mount structure of an optical head in an electronic photographing apparatus according to the present invention. In the drawing, the reference numeral 31 denotes a fixed bracket, which is the same as the fixed bracket 12 in FIG. 1, except that it integrally provides a bracket pushing spring 42 (a second urging means). The other structural members are indicated by the same reference numerals as FIG. 1.

The bracket pushing spring 42 urges the portion of the ring hole of the rotatable bracket 33 in a direction toward the photoconductor drum 1, i.e., in the direction parallel to the light path. Therefore, the micro-vibration of the rotatable bracket 33 at the portion of the elongated hole 35 can be restricted and the respective gap bearings 38 can be forced to the photoconductor drum 1, so that the distance between the photoconductor drum 1 and the optical head (LED array) 2 remain constant.

As a result, the problem in the prior art, i.e., a print disarray can be prevented. The bracket pushing spring 42 can be small enough to restrict micro-vibration, so that it does not affect the force of the gap bearings 38 for pushing the photoconductor drum 1.

As mentioned above, the respective gap bearings 38 of the optical head (LED array) are stably pushed to the photoconductor drum 1 at the respective ends thereof by means of the bracket pushing springs 42, so that the distance between the photoconductor drum 1 and the optical head 2 remains constant. Therefore, the beam from the optical head 2 is focused stably on the surface of the photoconductor drum 1 so as to prevent a print disorder.

According to the second embodiment as mentioned above, the respective gap bearings of the optical head (LED array) are in constant and stable contact with the surface of the photoconductor drum 1 at the respective ends thereof.

Industrial Applicability

It should be understood by those skilled in the art that the present invention can be applied to various kinds of electronic photographing apparatuses, in which light emitting element arrays each having a plurality of light emitting elements arranged parallel to the axis of the photoconductor drum are arranged with a certain interval along the outer surface of the photoconductor drum.

What is claimed is:

1. A mount structure of a light emitting element array in an electronic photographic apparatus, comprising a photoconductor drum (1) rotatably driven around an axis, a light emitting element array (2) having a plurality of light emitting elements (21) arranged parallel to the axis of the photoconductor drum (1) and opposite to an outer surface thereof, characterized by a fixed bracket (31) fixedly mounted on the electronic photographing apparatus;

a rotatable bracket (33) rotatably mounted on the fixed bracket (31) and fixedly secured to the light emitting element array (2);

a bias means (37) for urging the light emitting element array (2) against the outer surface of the photoconductor drum (1);

a space keeping means being pushed by the bias means (37) against the outer surface of the photoconductor drum (1) so as to maintain a constant distance between the light emitting element array (2) and the outer surface of the photoconductor drum (1);

wherein the rotatable bracket (33) is rotatably mounted on the fixed bracket (31) by a pair of bearings (34, 35) arranged a certain interval apart and parallel to the axis of the photoconductor drum (1); the rotatable bracket (33) is supported on said fixed bracket (31) so as to be movable toward or away from the photoconductor drum (1) at one of the bearings (35);

wherein said one of the bearings (35) comprises an elongated hole (35) formed by either one of the fixed bracket (31) and the rotatable bracket (33) and a shaft (32) provided on the other bracket and engaged with the elongated hole (35); and wherein the bias means (37) for urging the light emitting element array (2) against the outer surface of the photoconductor drum (1) comprises a pair of torsion springs arranged in the vicinity of said pair of bearings (34, 35), respectively.

2. A mount structure of a light emitting element array in an electronic photographing apparatus as set forth in claim 1, wherein the fixed bracket (31) and the rotatable bracket (33) are both made of rigid metal plates.

3. A mount structure of a light emitting element array in an electronic photographing apparatus as set forth in claim 1, wherein said space keeping means comprises bearings rotatably mounted on the light emitting element array (2) at the respective ends thereof in such a manner that said bearings are pushed against the outer surface of the photoconductor drum (1) and rotated by the rotation of the photoconductor drum (1).

4. A mount structure of a light emitting element array in an electronic photographing apparatus as set forth in claim 1, wherein said pair of springs each have a spiral portion which is spiralled around said shaft (32).

5. A mount structure of a light emitting element array in an electronic photographing apparatus, comprising a fixed bracket (31) and a rotatable bracket (33) rotatably mounted on the fixed bracket (31) at the respective ends thereof in the axial direction and provided with a light emitting element array (2) for forming an electrostatic latent image; said array having a plurality of light emitting elements (21) along the axial direction of the photoconductor drum (1) rotatably driven about an axis thereof and a pair of gap keeping means (38) for maintaining a gap with the photoconductor drum (1);

a first bias means provided between the fixed bracket (31) and the rotatable bracket (33), for urging the light emitting element array (2) so that both gap keeping means (38) are in contact with the photoconductor drum (1);

one of the respective axial ends at which said rotatable bracket (33) rotatably connected to said fixed bracket (31) being only rotatably supported to said fixed bracket (31), and the other end being connected to the same rotatably and movably toward and away from the photoconductor drum (1); and second bias means integrally mounted on said fixed bracket (31) for urging said other end of the rotatable bracket (33) toward said photoconductor drum (1).

6. A mount structure of a light emitting element array in an electronic photographing apparatus as set forth in claim 5, wherein one end of the rotatable bracket (33) is provided with a round hole (34) that is engaged with one end of a shaft (32) mounted on the fixed bracket (31), and the outer end is provided with an elongated hole (35) extending in a direction toward or away from the photoconductor drum (1) and engaged with the other end of said shaft (32).

7. A mount structure of a light emitting element array in an electronic photographing apparatus as set forth in claim 6, wherein said first bias means (37) comprises a pair of torsion springs mounted on said shaft (32) near rotatable connecting positions at the respective ends of the fixed bracket.

* * * * *